US008206643B2

(12) United States Patent
Sipilä et al.

(10) Patent No.: US 8,206,643 B2
(45) Date of Patent: Jun. 26, 2012

(54) CONCENTRATE BURNER

(75) Inventors: Jussi Sipilä, Espoo (FI); Kaarle Peltoniemi, Espoo (FI); Peter Björklund, Espoo (FI); Jiliang Xia, Pori (FI)

(73) Assignee: Outotec Oyj, Espoo (FI)

( * ) Notice: Subject to any disclaimer, the term of this patent is extended or adjusted under 35 U.S.C. 154(b) by 18 days.

(21) Appl. No.: 12/676,856

(22) PCT Filed: Sep. 1, 2008

(86) PCT No.: PCT/FI2008/050478

§ 371 (c)(1), (2), (4) Date: Mar. 5, 2010

(87) PCT Pub. No.: WO2009/030808

PCT Pub. Date: Mar. 12, 2009

(65) Prior Publication Data

US 2010/0207307 A1 Aug. 19, 2010

(30) Foreign Application Priority Data

Sep. 5, 2007 (FI) ..... 20075610

(51) Int. Cl.
*F27D 3/18* (2006.01)

(52) U.S. Cl. ..... 266/175; 266/182; 75/455

(58) Field of Classification Search ..... 266/221, 266/267, 216, 182, 266, 265; 75/455, 707, 75/454, 639, 694, 414
See application file for complete search history.

(56) References Cited

U.S. PATENT DOCUMENTS

| | | | | |
|---|---|---|---|---|
| 4,210,315 | A * | 7/1980 | Lilja et al. | 266/182 |
| 4,326,702 | A * | 4/1982 | Oueneau et al. | 266/267 |
| 4,392,885 | A | 7/1983 | Lilja et al. | |
| 5,133,801 | A * | 7/1992 | Saarinen | 75/707 |
| 5,362,032 | A | 11/1994 | Ranki | |
| 5,542,361 | A * | 8/1996 | Lilja et al. | 110/347 |
| 5,674,310 | A | 10/1997 | Miralles et al. | |

(Continued)

FOREIGN PATENT DOCUMENTS

FI 63259 C 5/1983

(Continued)

OTHER PUBLICATIONS

International Search Report for International Application No. PCT/FI2008/050478, mailed on Nov. 19, 2008.

(Continued)

*Primary Examiner* — Scott Kastler
*Assistant Examiner* — Michael Aboagye
(74) *Attorney, Agent, or Firm* — Locke Lord LLP

(57) ABSTRACT

A concentrate burner for feeding a pulverous concentrate mixture and reaction gas into a reaction shaft of a flash smelting furnace. The concentrate burner includes a feeder pipe for feeding a concentrate mixture into the reaction shaft and a dispersing device for directing dispersing gas to the concentrate mixture flowing around the dispersing device. For feeding the reaction gas into the reaction shaft, a gas supply device is provided which includes a reaction gas chamber for mixing the reaction gas with the concentrate mixture, and for directing the concentrate mixture to the side by the dispersing gas. The reaction gas chamber includes a turbulent flow chamber, to which an inlet channel opens tangentially for directing the reaction gas to the reaction gas chamber in a tangential direction. In the inlet channel, an adjusting member is arranged for adjusting the cross-sectional area of the reaction gas flow.

10 Claims, 3 Drawing Sheets

U.S. PATENT DOCUMENTS 6,238,457 B1 5/2001 Holmi et al.
6,565,799 B1 * 5/2003 Kojo et al. ..... 266/182

FOREIGN PATENT DOCUMENTS

Fl 94150 C 7/1995
Fl 100889 B1 3/1998
Fl 98071 B 12/2006
GB 2 090 159 A 7/1982

OTHER PUBLICATIONS

Written Opinion for International Application No. PCT/FI2008/050478, mailed on Nov. 19, 2008.

* cited by examiner

CONCENTRATE BURNER

This application is a national phase entry under 35 U.S.C. §371 of International Application Number PCT/FI2008/050478, filed on Sep. 1, 2008, entitled "CONCENTRATE BURNER", which claims the benefit of Finnish Patent Application Number 20075610, filed on Sep. 5, 2007, all of which are hereby incorporated by reference.

FIELD OF THE INVENTION

The invention relates to a concentrate burner defined in the preamble of claim 1.

BACKGROUND OF THE INVENTION

A flash smelting process takes place in a flash smelting furnace that consists of three sections: a reaction shaft, a lower furnace, and an uptake. In the flash smelting process, a pulverous concentrate mixture that consists of sulphidic concentrates, fluxes, and other pulverous components, is mixed with a reaction gas by means of the concentrate burner in the upper part of the reaction shaft. The structure of the concentrate burner plays a radical role in the proper functioning of the flash smelting process. The reaction gas can comprise air, oxygen-enriched air or oxygen. The concentrate burner comprises a number of concentric channels, through which the reaction gas and the concentrate are blown to and mixed in the furnace. Concentrate burners are known previously, for example, from publications FI 98071 B and FI 100889 B. This burner, known as the Outokumpu burner, comprising separate channels for the pulverous solid matter, such as concentrate, and flux, and process gas, is globally the most widely used burner in flash smelting furnaces. The concentrate burner includes a feeder pipe, its orifice opening to the reaction shaft for feeding the pulverous matter to the reaction shaft. It is preferable to use air or part of the reaction gas as a dispersing gas, and to feed it from the inside of the feeder pipe along a dispersing pipe. The upper surface of the lower part of the dispersing pipe is designed so as to be outwards curved and its lower edge is provided with holes that are directed to the side, through which the reaction gas is fed essentially horizontally towards the pulverous solid matter falling downwards. The dispersing pipe is arranged concentrically inside the feeder pipe and it extends to a distance from the orifice inside the reaction shaft for directing the dispersing gas to the concentrate powder flowing around the dispersing pipe. The main part of the reaction gas is fed into the reaction shaft through a gas supply device. The gas supply device includes a reaction gas chamber, which is outside the reaction shaft and opens to the reaction shaft through an annular discharge orifice that concentrically surrounds the central feeder pipe for mixing the reaction gas discharging from the discharge orifice with the flow of pulverous matter that runs from the feeder pipe by means of gravity and is directed sideward by means of the dispersing gas. The main purpose of the concentrate burner is to provide an optimal suspension of the solid particles and the reaction gas in the reaction shaft. Individual particles are heated and, after ignition, they begin to burn with the oxygen that is in the reaction gas. Combustion reactions with fine sulphides are quick and an essential amount of heat is released, resulting in a perfect melting of the concentrate mixture particles and the other solid matters in the feed mixture. The melted particles flow downward and accumulate in the lower furnace, where slag and the sulphidic matte settle into separate layers. The combustion gas (mainly a mixture of $SO_2$ and $N_2$) flows through the uptake to a waste heat boiler, where its heat is recovered.

Publications CN 2513062Y and CN 1246486C disclose a concentrate burner, wherein the reaction gas chambers that are arranged within each other are formed into turbulent flow chambers to provide a turbulent flow of the reaction gas discharging from the discharge orifice. Each reaction gas chamber includes a cylindrical upper part, to which an inlet channel opens tangentially for conducting the reaction gas to the interior in a tangential direction, and a conical lower part, which converges conically from the cylindrical upper part down towards the discharge orifice. With this arrangement, the reaction gas can be made to swirl in the reaction gas chamber, where it exits swirling from the discharge orifice to the reaction shaft.

One problem with the known concentrate burner is that there is no way of adjusting the amount of turbulence. The turbulence can ignite an excessively effective flame too quickly, causing problems to the middle part of the shaft.

SUMMARY OF THE INVENTION

The purpose of the invention is to eliminate the drawbacks mentioned above.

Another purpose of the invention is to further improve and enhance the flash smelting process.

A special purpose of the invention is to disclose a concentrate burner, which

- extends the processing time of the concentrate mixture particles in the reaction shaft,
- improves the mixing of the substances, which are fed by the concentrate burner, to form a suspension, and the chemical reaction between the same,
- improves the efficiency of the oxygen use, and
- improves the stability of the flame and provides a shape of flame more advantageous than before.

The concentrate burner according to the invention is characterized in that which is presented in the claims.

A concentrate burner for feeding a pulverous concentrate mixture and reaction gas into the reaction shaft (1) of a flash smelting furnace. The concentrate burner includes a feeder pipe (2) for feeding the concentrate mixture into the reaction shaft (1), the orifice (3) of the feeder pipe opening to the reaction shaft, a dispersing device (4), which is arranged concentrically inside the feeder pipe (2) and which extends to a distance from the orifice inside the reaction shaft (1) for directing dispersing gas to the concentrate mixture flowing around the dispersing device. For feeding the reaction gas into the reaction shaft (1), a gas supply device (5) includes a reaction gas chamber (6), which is located outside the reaction shaft and opens to the reaction shaft (1) through an annular discharge orifice (7) that surrounds the feeder pipe (2) concentrically for mixing the reaction gas discharging from the discharge orifice with the concentrate mixture discharging from the middle of the feeder pipe, the concentrate mixture being directed to the side by means of the dispersing gas. The reaction gas chamber (6) comprises a turbulent flow chamber, to which an inlet channel (9) opens tangentially for directing the reaction gas to the reaction gas chamber in a tangential direction. In the inlet channel (9), an adjusting member (11) is arranged for adjusting the cross-sectional area of the reaction gas flow.

According to the invention, an adjusting member is arranged in the inlet channel for adjusting the cross-sectional area of the reaction gas flow.

This enables the adjustment of the turbulence velocity discharging from the discharge orifice. The amount of turbulence can be adjusted. If the turbulence ignites too effective a flame too quickly, causing problems to the middle part of the shaft, the adjusting member can be used to adjust the amount of turbulence and to drop it to almost zero.

In an application of the concentrate burner, the reaction gas chamber includes a cylindrical upper part, to which the inlet channel opens tangentially, and a conical lower part, which converges conically from the cylindrical upper part down towards the discharge orifice.

In an application of the concentrate burner, the inlet channel has a rectangular cross section. The rectangular inlet channel is structurally and flow-technically advantageous. The flow of reaction gas from the rectangular inlet channel to the reaction gas chamber is even throughout its width.

In an application of the concentrate burner, guide vanes are arranged in the reaction gas chamber to define a swirl angle of the turbulent flow of the reaction gas. As the swirl angle remains constant in various operating conditions, such as alternating turbulence velocities and volume flow rates, the guide vanes can be used to improve the stability of the flame. Therefore, the flow pattern remains quite the same in the varying conditions. The stability of the flame, the mixing, the chemical reaction, and the efficiency of the oxygen use are improved. As a negative radial velocity is achieved, or the radial movement of the process gas is limited, the mixing of the concentrate mixture particles and the process gas can also be improved and, then, the efficiency of oxygen use can be increased. Furthermore, all advantages achievable by the turbulent flow are obtained; in other words, an increase in the processing time of the concentrate mixture particles in the reaction shaft, mixing of the substances that are fed by the concentrate burner to form a suspension, and an improvement in the chemical reaction between the same, an improvement in the efficiency of the oxygen use, and an improvement in the flame stability, and a provision of a flame shape more advantageous than before (a suitable width and a suitable length). The high efficiency of the oxygen use makes the concentrate burner especially advantageous to be used in what are known as the Direct Blister Smelting and the DON process, wherein the degrees of oxidation are high. The Direct Blister Smelting is a flash smelting process of copper, yielding blister copper. The DON process (Direct Outokumpu (Outotec) Nickel Process) is a flash smelting process of nickel.

In an application of the concentrate burner, guide vanes are arranged in the area of the conical lower part of the reaction gas chamber.

In an application of the concentrate burner, there is an area free of guide vanes in the lower part at the lower end adjacent to the discharge orifice. This can facilitate the removal of agglomerations from the vicinity of the guide vanes and, still, it is possible to provide an optimal swirl angle for the reaction gas, determined by the guide vanes. It should be noted that the guide vanes could also be placed closer to the inlet channel, depending on the conditions of the applications.

In an application of the concentrate burner, the annular discharge orifice of the reaction gas chamber, in the lateral direction and outwards, is limited by a wall part that has the shape of a truncated cone, converging down and inward at an angle θ to the vertical axis. Such an inward inclination of the outer wall of the annular discharge orifice is advantageous, as it can further be used to improve the stability of the flame, increase the processing time of the concentrate mixture particles, improve the mixing and the chemical reaction, and to provide a preferable shape of flame. In most known burner structures, the frusto-conical wall part mentioned above expands down and outwards at an angle to the vertical axis, causing a positive radial velocity in the turbulent flow discharging from the discharge orifice, which in turn can result in a poor mixing of the reaction gas and the concentrate mixture particles, and could thus result in flow conditions disadvantageous to the chemical reaction and the combustion. The positive radial velocity increases with the amount of turbulence increasing. A high turbulence that has a high tangential velocity can have a positive radial velocity so great that the flame may expand (which is not good for the refractory lining of the furnace), and instable burning can occur. Under the effect of the centrifugal forces occurring in the turbulent flow conditions, jointly with the radial positive velocity, some concentrate mixture particles may also reach the wall of the furnace. With an arrangement, where the annular discharge orifice of the reaction gas chamber, in the lateral direction and outwards, is limited by the frusto-conical wall part that converges down and inwards at the angle θ to the vertical axis, a negative radial velocity is provided in the turbulent flow discharging from the discharge orifice. Depending on the angle θ that is inwards inclined, the positive radial velocity can still occur in a very strong turbulent flow that has a very high tangential velocity, but compared to the conventional burner, this positive radial velocity can be considerably decreased. The exact location of the reactions of the discharge area most likely shifts to a place that is more downstream, due to the continuously downward-converging area. With the aid of the angle mentioned above, a preferable flow pattern is provided to stabilize the flame, the chemical reaction is improved, and a preferable shape of flame is provided (not too wide and not too long). This results in a higher efficiency of oxygen use, which, as already mentioned, is critical in the direct blister smelting and, to some extent, also in the DON process.

In an application of the concentrate burner, the angle θ is about 20° to 50°, preferably about 30° to 35°.

In an application of the concentrate burner, the concentrate burner includes an adjusting body, which is arranged around the feeder pipe to be movable under the control and in the direction of the feeder pipe for adjusting the cross-sectional area of the discharge orifice. The concentrate burner further includes adjusting rods, which are arranged outside the feeder pipe to move the adjusting body. In addition, the concentrate burner includes a casing tube, which is adapted to surround the feeder pipe and the adjusting rods to provide an essentially undisturbed turbulent flow in the reaction gas chamber. The adjusting rods that are covered with the casing tube do not influence the flow, whereby as few disturbances as possible occur in the flow in the reaction gas chamber.

BRIEF DESCRIPTION OF THE DRAWINGS

In the following, the invention is described in detail by means of exemplary embodiments and with reference to the appended drawing, in which.

DETAILED DESCRIPTION OF THE INVENTION

Figure 1:
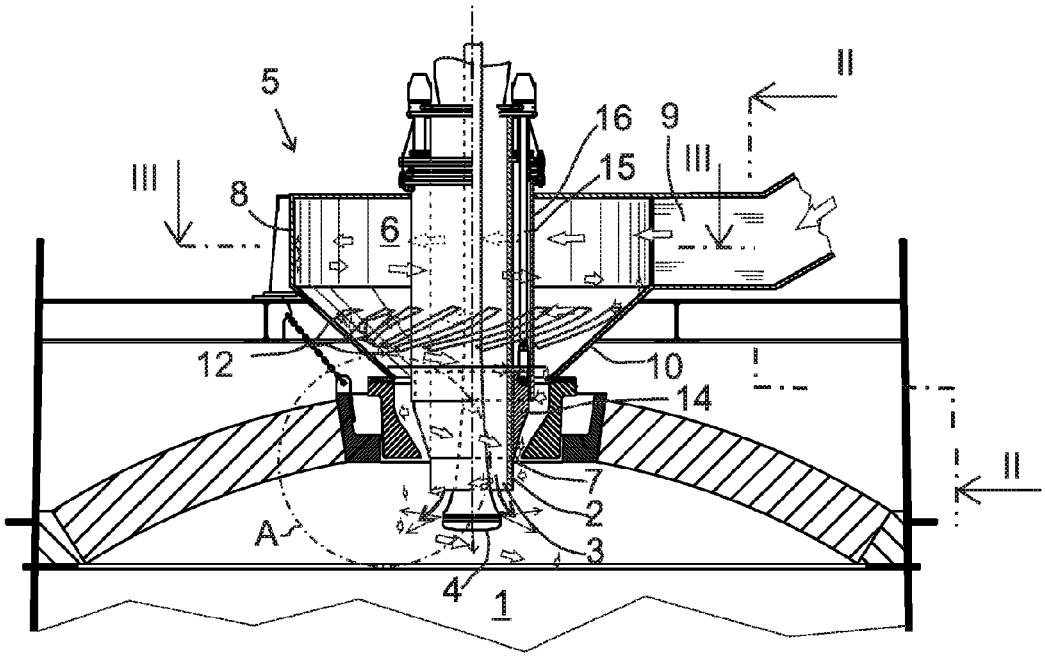
FIG. 1 shows a schematic cross section of an embodiment of the concentrate burner according to the invention.

FIG. 1 shows a concentrate burner that is installed in the upper part of the reaction shaft 1 of a flash smelting furnace to feed pulverous concentrate mixture and reaction gas to the reaction shaft 1 of the flash smelting furnace.

The concentrate burner includes a feeder pipe 2, its orifice 3 opening to the reaction shaft for feeding the concentrate mixture into the reaction shaft 1. Inside the feeder pipe 2, there is a dispersing device 4 that is placed concentrically, extending to a distance from the orifice 3 towards the inside of the reaction shaft 1. The dispersing device 4 directs the gas that is fed through it from the lower edge of the device to the side towards the flow of solid matter that is directed downwards outside the dispersing device. Furthermore, the concentrate burner includes a gas supply device 5 for feeding the reaction gas into the reaction shaft 1. The gas supply device includes a reaction gas chamber 6, which is located outside the reaction shaft 1 and opens to the reaction shaft 1 through an annular discharge orifice 7 that surrounds the feeder pipe 2 concentrically. The reaction gas discharging from the discharge orifice 7 is mixed with the pulverous solid matter that discharges from the middle of the feeder pipe 2 to form a suspension, the solid matter in the vicinity of the orifice 7 being directed sideward by means of the gas that is blown from the dispersing device.

The reaction gas chamber 6 is formed into a turbulent flow chamber to provide a turbulent flow of the reaction gas discharging from the discharge orifice 7. For this purpose, the reaction chamber 6 includes a cylindrical upper part 8, to which an inlet channel 9 tangentially opens. The reaction gas enters the interior of the reaction chamber 6 in a tangential direction, generating a turbulent flow of the reaction gas, which advances conically from the cylindrical upper part 8 through the downwards converging, conical lower part 10 and out of the discharge orifice 7. In the reaction gas chamber 6, there are guide vanes 12 arranged to define the swirl angle of the turbulent flow of the reaction gas. The guide vanes 12 are arranged in the area of the conical lower part 10 of the reaction gas chamber 6. At the lower end adjacent to the discharge orifice 7 of the lower part 10, there is an area free of guide vanes 12.

Figure 2:
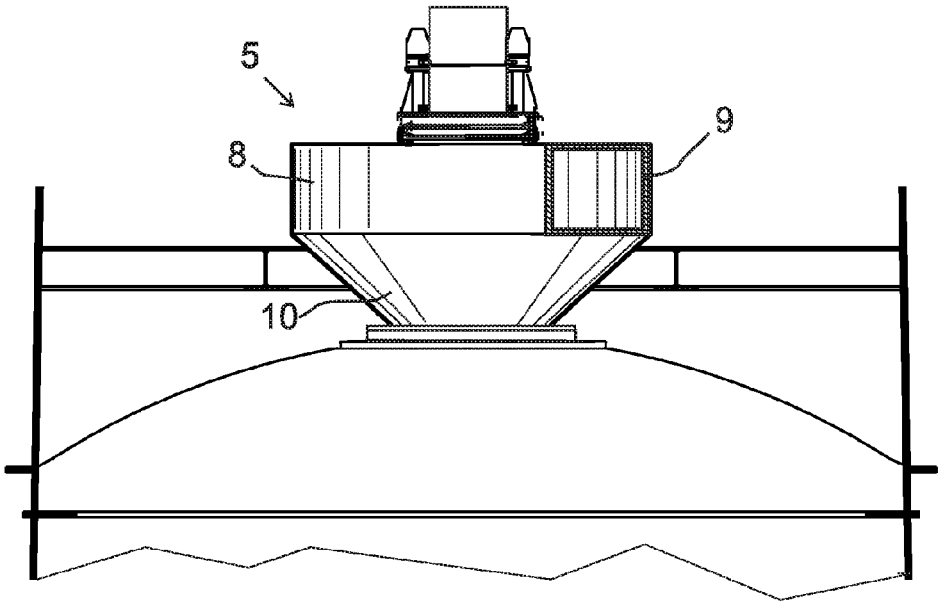
FIG. 2 shows the concentrate burner of FIG. 1 as viewed in the direction II-II.

As shown in FIG. 2, the inlet channel 9 has a rectangular cross section.

Figure 3:
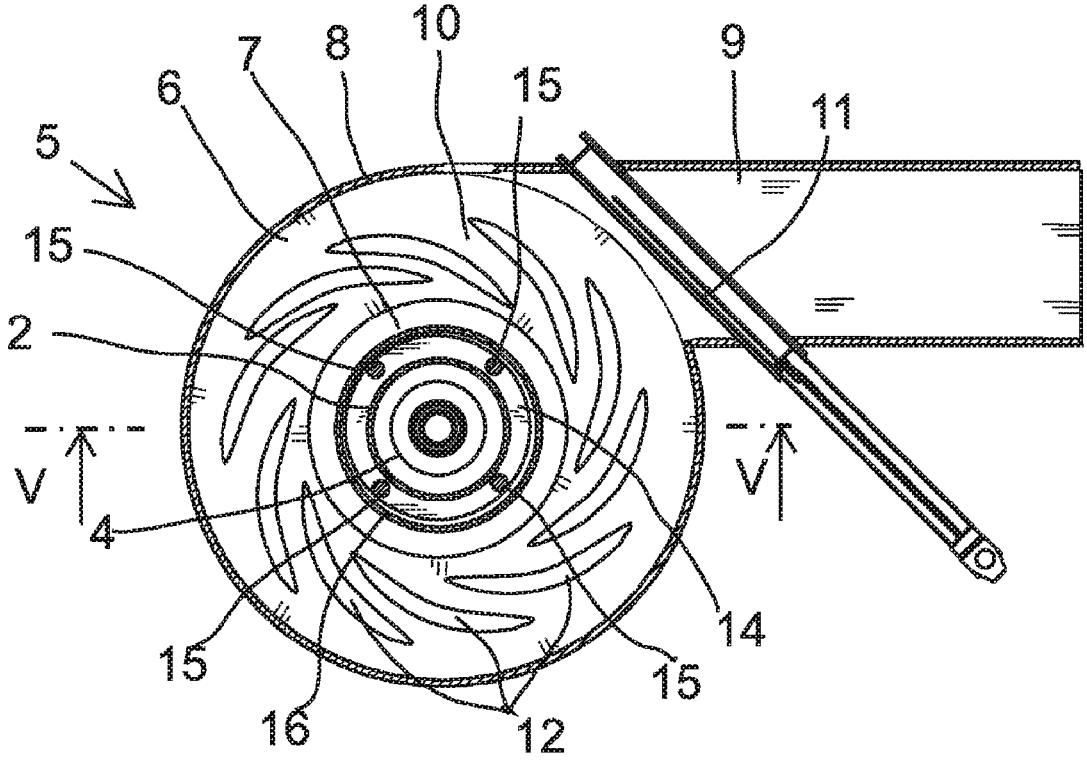
FIG. 3 shows section III-III of FIG. 1.

FIG. 3 shows that in the inlet channel 9, there is an adjusting member 11 arranged for adjusting the cross-sectional area of the reaction gas flow. The adjusting member 11 comprises an adjusting valve, which is controlled to be movable across the inlet channel 9 at an angle to its longitudinal direction and in an essentially tangential direction to the reaction gas chamber 6. The adjusting valve 11 can be used to adjust the velocity of the inlet flow of the reaction gas.

FIGS. 1 and 3 show that the concentrate burner includes an adjusting body 14, which is arranged around the feeder pipe to be movable under the control and in the direction of the feeder pipe to adjust the cross-sectional area of the discharge orifice 7. Adjusting rods 15, which are arranged outside the feeder pipe 2 to move the adjusting body 14. A casing tube 16, which is adapted to surround the feeder pipe 2 and the adjusting rods 15 to provide an essentially undisturbed turbulent flow in the reaction gas chamber.

Figure 4:
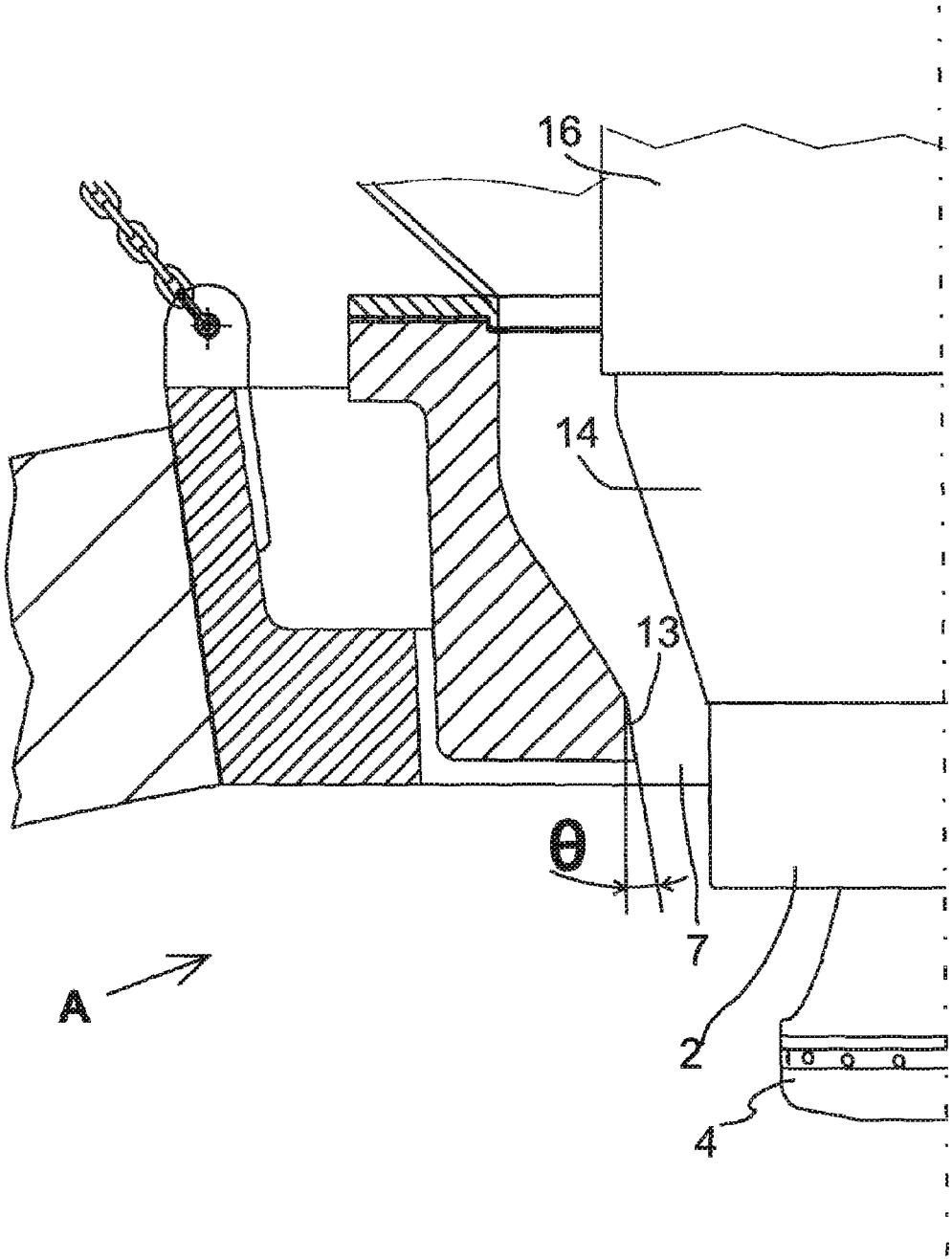
FIG. 4 shows an enlarged detail A of FIG. 1.

FIG. 4 shows that the annular discharge orifice 7 of the reaction gas chamber 6, in the lateral direction and outwards, is limited by a frusto-conical wall part 13, which converges down and inwards at an angle θ to the vertical axis. The angle θ is about 20° to 50°, preferably about 30° to 35°.

The invention is not limited to the above exemplary embodiments only, but various modifications are possible within the inventive idea defined by the claims.

The invention claimed is:

1. A concentrate burner for feeding a pulverous concentrate mixture and reaction gas into a reaction shaft of a flash smelting furnace, comprising:

a feeder pipe for feeding the concentrate mixture into the reaction shaft through an orifice of the feeder pipe opening to the reaction shaft, a dispersing device, which is concentrically arranged inside the feeder pipe and which extends to a distance from the orifice inside the reaction shaft, for directing dispersing gas to the concentrate mixture that flows around the dispersing device, a gas supply device for feeding the reaction gas into the reaction shaft, the gas supply device including a reaction gas chamber, which is outside the reaction shaft and opens to the reaction shaft through an annular discharge orifice that surrounds the feeder pipe concentrically for mixing the reaction gas discharging from the discharge orifice with the pulverous solid matter discharging from a middle of the feeder pipe, the solid matter being directed sideward by means of a dispersing gas, the reaction gas chamber being formed into a turbulent flow chamber to provide a turbulent flow of the reaction gas discharging from the discharge orifice, an inlet channel opening tangentially to the reaction gas chamber for directing the reaction gas to the reaction gas chamber in a tangential direction, wherein an adjusting member is arranged in the inlet channel for adjusting a cross-sectional area of the reaction gas flow, an adjusting body, which is arranged around the feeder pipe to be movable under the control and in the direction of the feeder pipe for adjusting the cross-sectional area of the discharge orifice.

2. A concentrate burner according to claim 1, wherein the reaction gas chamber includes a cylindrical upper part, to which the inlet channel tangentially opens, and a conical lower part, which converges conically from the cylindrical upper part down towards the discharge orifice.

3. A concentrate burner according to claim 1, wherein the inlet channel has a rectangular cross section.

4. A concentrate burner according to claim 1, wherein, in the reaction gas chamber, guide vanes are arranged to define a swirl angle of the turbulent flow of the reaction gas.

5. A concentrate burner according to claim 4, wherein guide vanes are arranged in the area of the conical lower part of the reaction gas chamber.

6. A concentrate burner according to claim 4, wherein the lower part comprises an area free of guide vanes in the vicinity of the discharge orifice.

7. A concentrate burner according to claim 1, wherein the annular discharge orifice of the reaction gas chamber, in the lateral direction and outwards, is limited by a frusto-conical wall part, which converges down and inwards at an angle θ to the vertical axis.

8. A concentrate burner according to claim 7, wherein the angle θ is about 20° to 50°.

9. A concentrate burner according to claim 1, wherein the concentrate burner includes adjusting rods, which are arranged outside the feeder pipe for moving the adjusting body; and a casing tube, which is adapted to surround the feeder pipe and the adjusting rods to provide an essentially undisturbed turbulent flow in the reaction gas chamber.

10. A concentrate burner according to claim 7, wherein the angle θ is about 30° to about 35°.

* * * * *